United States Patent [19]

Gala

[11] 4,070,568

[45] Jan. 24, 1978

[54] LAMP CAP FOR USE WITH INDICATING LIGHT ASSEMBLY

[75] Inventor: Babulal Virji Gala, Huntsville, Ala.

[73] Assignee: GTE Automatic Electric Laboratories Incorporated, Northlake, Ill.

[21] Appl. No.: 749,208

[22] Filed: Dec. 9, 1976

[51] Int. Cl.[2] ..... F21V 5/04

[52] U.S. Cl. ..... 362/311; 362/455

[58] Field of Search ..... 240/25, 106.1, 151, 240/8, 16; 200/314; 340/383

[56] References Cited

U.S. PATENT DOCUMENTS

| | | | |
|---|---|---|---|
| D. 141,064 | 5/1945 | Zimmerman | 240/106.1 UX |
| 3,183,333 | 5/1965 | Golbeck | 200/314 X |
| 3,267,244 | 8/1966 | Schultz | 200/314 |
| 3,663,780 | 5/1972 | Golbeck | 200/314 |

*Primary Examiner*—L. T. Hix
*Assistant Examiner*—M. L. Gellner
*Attorney, Agent, or Firm*—Robert J. Black

[57] ABSTRACT

A lamp cap for use with an indicating light assembly or illuminated push button wherein the light source is a light emitting diode or other low output light producing device. A light concentrating lens is included which conducts light from the light source to the top of the lamp cap wherein a concentrated light pattern appears to indicate operation of the associated light producing device.

8 Claims, 2 Drawing Figures

LAMP CAP FOR USE WITH INDICATING LIGHT ASSEMBLY

BACKGROUND OF THE INVENTION

1. Field of the Invention

The present invention relates to light indicating devices and more particularly to a lamp cap for use with such light indicating devices, particularly when the source of light provided is from a light emitting diode or similar low output light producing device.

2. Description of the Prior Art

The use of indicating light devices or more commonly pilot lights, is well known in the electronics field. Such devices are frequently combined with various switching devices to provide an indication of the off/on condition of the associated switching device. Simple pilot lights are usually employed as indicators of circuit condition (viz: on/off, etc.).

When a number of such indicating devices or switching devices including associated pilot lamps are provided a distinction between one or more indicators or switches must be made, which may take the form of labeling or providing a colored lamp cap over the light indicating device whereby those lamps which are operated are easily recognized and distinguished from others that may be located in a similar environment. As further means of distinguishing, inscriptions are sometimes included on the top surface of such lamp caps so that an alpha-numeric or similar designation is visible on the top of the lamp cap.

An illuminated push button switch including a light source and including a lamp cap of conventional design is shown in U.S. Pat. No. 3,183,333. Another form of illuminated push button wherein light from a remote source is transmitted by means of a conductive light bar to push buttons to form illumination is taught by U.S. Pat. No. 3,213,269. Such devices require light sources of fairly high output to provide a reasonably high degree of illumination particularly when the indicating devices or switches are employed in an environment where the illumination levels are fairly high.

A particular disadvantage of most prior art indicating lamps and illuminated switching devices is the requirement that a fairly bright incandescent or similar lamp be utilized as the light source. Such incandescent lamps have a fairly short life and also are costly to operate because of their current demands.

Recently light emitting diodes have been utilized as indicating devices in the electronics field, because of their small component size and very low current demands. Such devices however have been of marginal effectiveness, however because of their relatively low light output. Nevertheless, because of their longer life and their resistance to shock and vibration the light emitting diode appears as a desirable light producing device for use in light indicating devices and similar applications. Accordingly it is the object of the present invention to provide a lens for use with light indicating devices employing light emitting diodes as the source of illumination, which concentrate the limited light available from a light emitting diode into a form where it is readily visible even in highly illuminated environments.

SUMMARY OF THE INVENTION

The present invention consists of a lamp cap manufactured of plastic or similar material which may be connected to the top of the lamp indicating assembly by one or more techniques. The upper or top surface of the lamp cap is light transparent and may be either clear or colored depending upon the particular requirements of the system wherein the light indicating device is to be utilized. The lamp cap may be affixed to a pilot light structure or to a switching device that includes a lamp to indicate its operational status.

Affixed to the under side of the top portion of the lamp cap is a light concentrating lens structure placed off-center from the center of the lamp cap. The lamp cap itself is centered directly over the light emitting diode which is utilized as a light source in the light indicating device in such a manner to concentrate the light and brings a bright pattern of illumination to the top surface of the lamp cap when light from the light emitting diode is reflected through the lens. General lighting is also provided by this means to the entire top surface of the lamp cap with a bright wedge or v-shaped pattern present at a portion of the lens area.

Positioning of the lens off-center from the center of the button gives the best bright pattern of light at the top surface of the lamp cap. The upper surface of the lamp cap as indicated is light transparent and is made out of a material the same color as the light output of the light emitting diode that provides the illumination source. Proper matching of the wave length of the color of the lamp cap to the color of the light emitting diode provides the greatest contrast between any adjacent pilot lamp assemblies and permits the viewer to rapidly identify the lighted indicating device.

DESCRIPTION OF THE PREFERRED EMBODIMENT

Figure 1:
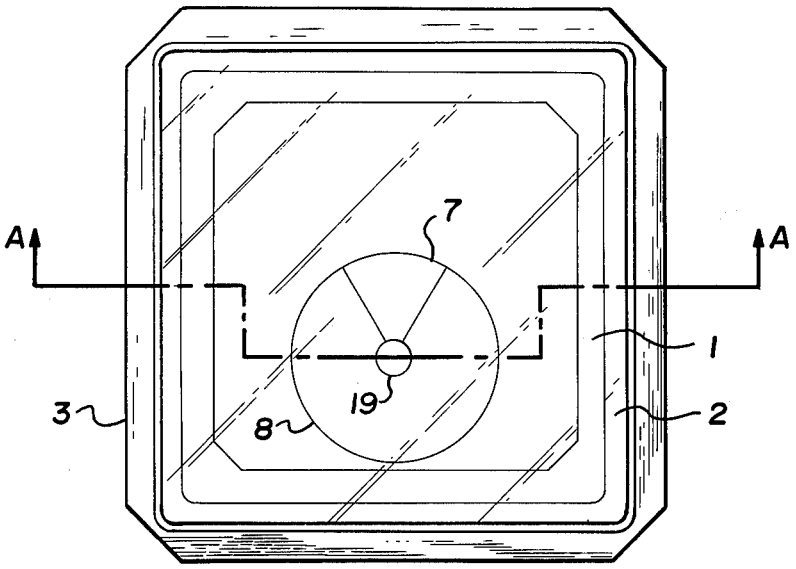
FIG. 1 is a top view of a lamp indicating device employing a light emitting diode as the illumination source and including a lamp cap in accordance with the present invention.

Referring now to FIG. 1 of the drawings the lamp indicating assembly viewed from above is shown wherein the general shape of the lamp cap is visible as well as the position of a light concentrating lens 8 and an indication of the bright visible light pattern 7 that appears on such lens when a light source positioned directly below the center of the lamp cap is illuminated. A more thorough understanding of the present invention may be had by reference to FIG. 2 which is a partial section of an indicating lamp device in accordance with the present invention taken along a section line A—A of FIG. 1.

In at least one embodiment of a lamp cap embodying the principles of the present invention, an upper support section 1 constructed of colored light transparent material of the same color as the associated light output of a light emitting diode 4 is utilized. This support section 1 includes a lens portion 8 whose shape in the present invention is conical. The inclined and top surfaces of said conical lens portion are etched to provide maximum reflection of light. It should be noted also that cone 8 has a flat spot at its apex which provides a bright spot of light 19 when the indicating device is viewed straight from the top of the indicating device. Light transmitted by the normally narrow view light emitting diode passed through the lens undergoes a refraction and reflection process. During this process the lens 8 concentrates the light and brings it to the top surface of the lens in the bright pattern 7 shown in FIG. 1. This lens also helps to illuminate the entire surface of the lamp cap.

Section 1 has a base portion 3 and a lower mounting edge 9 adapted to engage an associated indicating lamp base structure 10 which includes ears 11 and 12 which engage recesses 13 and 14 respectively. Included on two sides of the lamp cap support portion 1 are also openings or indentions 15 and 16 which are adapted to receive an outer lamp cap cover 2. The lamp cap cover includes bosses or ears 17 and 18 which are adapted to engage openings 15 and 16 respectively and thus secure the outer lamp cap cover 2 to the lamp cap support element 1.

Figure 2:
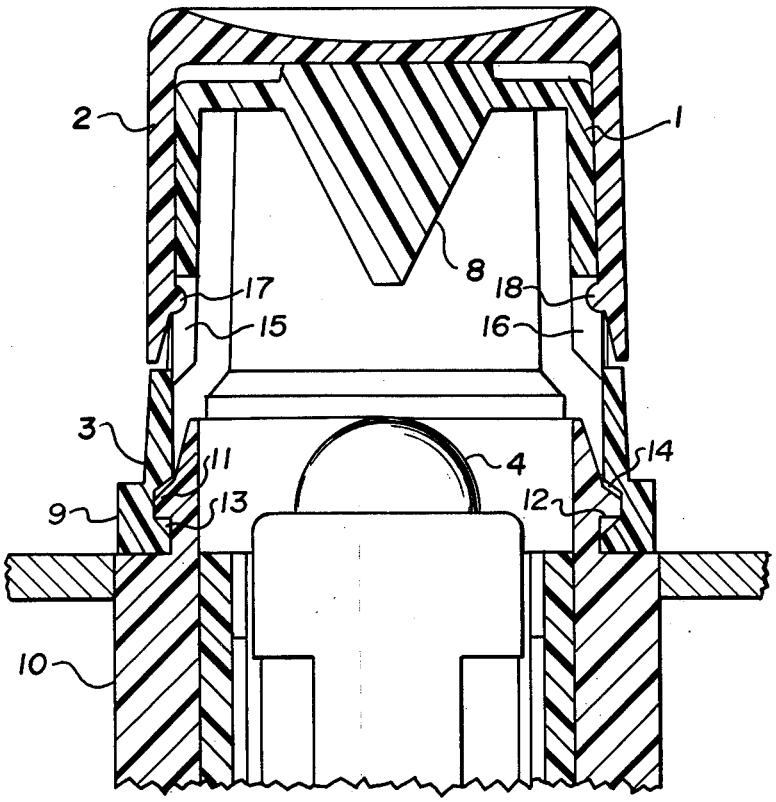
FIG. 2 is a partial sectional view of a lamp indicating device taken along lines A—A of FIG. 1.

A paper or similar material designation strip may be placed between the support element 1 and the outer cover 2 to provide further identification of the individual lamp cap as long as the upper portion of the lens area 8 is visible through the upper lamp cap cover. Since the top surface of the lens protrudes through any associated designation strip as shown in FIG. 2 it makes the bright illuminated pattern more readily visible through the clear cover 2. This illuminated pattern of light follows around a 360° circle, which facilitates seeing the illumination of the lamp cap from different directions.

As shown in FIG. 2 the illuminating source for the present indicating device is a light emitting diode 4 which may be of any well known commercial variety mounted in a base similar to those provided for incandescent lamps in indicating lamp devices similar to that disclosed in the present invention.

It will be evident from the above that the present invention could be practiced by combining the construction of the lamp cap support portion 1 and lamp cap cover 2 as a single unit and that the particular shape of the lamp cap of the present invention not be limited to the cube shape shown in the drawings. Alternately a conoidal design with flat top could be employed as well as a cylindrical embodiment could be constructed. The only specific requirement is that a light concentrating lens be included in the upper surface of the lamp cap positioned in such a manner that light is both reflected and refracted through the lens to the upper surface and that the lens be positioned when viewed from above off-center relative to the light source.

It should also be obvious in the above it is not necessary to limit the light source to the use of light emitting diodes. And that while the above outlined construction has indicated light transparent plastic material for the lamp cap support portion and the cover portion, only the top surfaces need necessarily be transparent while the side portions could be light opaque. Similarly materials other than the specified plastic could be employed for the structure of the present invention the only requirement again being that the upper portion be light transparent.

From the foregoing description it will be obvious to those skilled in the art that numerous modifications of the above invention may be made without departing from the spirit of the present invention which should be limited only by the scope of the claims appended hereto.

What is claimed is:

1. A lamp cap for use with indicating light assembly comprising: A substantially flat upper portion; supported by wall means extending in a downward direction from said upper portion to form an open bottomed structure having a hollow interior; said upper portion including an off-center positioned frusto-conical shaped lens; said lens extending downward from said upper portion and positioned within said wall means; said wall means further adapted to releasably engage said indicating light assembly.

2. A lamp cap as claimed in claim 1 wherein said upper portion is constructed of light transparent material.

3. A lamp cap as claimed in claim 1 there is further provided cover means of light transparent material covering all of said upper portion and substantially all of said wall means.

4. A lamp cap as claimed in claim 3 wherein said wall means further include receiving means; and said cover means include projecting means adapted to engage said receiving means.

5. A lamp cap as claimed in claim 3 wherein identification means are provided between said lens cap upper portion and said cover means.

6. A lamp cap as claimed in claim 1 wherein said lens includes an exterior surface treated to increase the light reflection characteristics of said lens.

7. A lamp cap as claimed in claim 1 wherein said indicating light assembly includes a light source providing illumination at a predetermined wave length; and said upper portion and said lens are constructed of light transparent material of a color having the same wave length as said light source.

8. A lamp cap as claimed in claim 7 wherein said light source is a light emitting diode positioned directly below the center of said upper portion.

* * * * *